US008225616B2

(12) United States Patent
Wilkinson et al.

(10) Patent No.: US 8,225,616 B2
(45) Date of Patent: Jul. 24, 2012

(54) PORTABLE MEDICINE COOLER HAVING AN ELECTRONIC COOLING CONTROLLER AND MEDICINE EFFICACY INDICATION CIRCUITRY AND METHOD OF OPERATION THEREOF

(75) Inventors: Michael R. Wilkinson, Richardson, TX (US); H. Michael Willey, Garland, TX (US)

(73) Assignee: KEWL Innovations, Inc., Plano, TX (US)

( * ) Notice: Subject to any disclaimer, the term of this patent is extended or adjusted under 35 U.S.C. 154(b) by 786 days.

(21) Appl. No.: 12/240,978

(22) Filed: Sep. 29, 2008

(65) Prior Publication Data

US 2009/0100843 A1 Apr. 23, 2009

Related U.S. Application Data

(60) Provisional application No. 60/981,876, filed on Oct. 23, 2007.

(51) Int. Cl.
*F25B 212/02* (2006.01)

(52) U.S. Cl. ..... 62/3.62; 62/3.7

(58) Field of Classification Search ..... 62/3.3, 62/3.6, 3.62, 3.7, 126, 129, 264, 419; 206/570
See application file for complete search history.

(56) References Cited

U.S. PATENT DOCUMENTS

| | | | | |
|---|---|---|---|---|
| 3,148,515 | A | | 9/1964 | Jentis et al. |
| 4,250,998 | A | | 2/1981 | Taylor |
| 4,343,158 | A | | 8/1982 | Campbell |
| 4,407,133 | A | | 10/1983 | Edmonson |
| 4,429,793 | A | | 2/1984 | Ehmann |
| 4,738,113 | A | * | 4/1988 | Rudick ..... 62/3.5 |
| 4,738,364 | A | | 4/1988 | Yeager |
| 5,320,162 | A | * | 6/1994 | Seaman ..... 165/255 |
| 5,413,166 | A | * | 5/1995 | Kerner et al. ..... 165/58 |
| 5,572,873 | A | * | 11/1996 | Lavigne et al. ..... 62/3.62 |
| 5,621,614 | A | * | 4/1997 | O'Neill ..... 361/698 |
| 5,704,223 | A | | 1/1998 | MacPherson et al. |
| 5,865,032 | A | | 2/1999 | MacPherson et al. |
| 5,865,314 | A | | 2/1999 | Jacober |
| 5,934,099 | A | | 8/1999 | Cook et al. |
| 5,956,968 | A | | 9/1999 | Grabowski |
| 6,044,650 | A | | 4/2000 | Cook et al. |
| 6,253,570 | B1 | | 7/2001 | Lustig |
| 6,935,133 | B2 | | 8/2005 | Keeter et al. |
| 6,959,814 | B1 | | 11/2005 | Hyman |
| 7,240,513 | B1 | | 7/2007 | Conforti |
| 2005/0016895 | A1 | | 1/2005 | Glenn |
| 2005/0081558 | A1 | | 4/2005 | Yoshida |

* cited by examiner

*Primary Examiner* — Mohammad Ali

(57) ABSTRACT

A portable medicine cooler and a method of operating the same. In one embodiment, the portable medicine cooler includes: (1) a shell having a grille and further having a door configured to provide access to a cavity within the shell for containing a medicine to be cooled, (2) a cooling and receiver structure coupled to the shell and including a thermoelectric cooler interposing a heat sink and a vial receiver and (3) electronic cooling control and medicine efficacy indication circuitry coupled to the cooling and receiving structure and including a processor, at least one temperature sensor configured to provide a signal to the processor indicating a temperature associated with the portable medicine cooler, a battery configured to provide power to the processor and an indicator selected from the group consisting of at least one light-emitting diode and a liquid-crystal display and configured to provide an indication of an operation of the portable medicine cooler.

20 Claims, 9 Drawing Sheets

PORTABLE MEDICINE COOLER HAVING AN ELECTRONIC COOLING CONTROLLER AND MEDICINE EFFICACY INDICATION CIRCUITRY AND METHOD OF OPERATION THEREOF

CROSS-REFERENCE TO PROVISIONAL APPLICATION

This application claims priority based on U.S. Provisional Patent Application Ser. No. 60/981,876, filed by Wilkinson, et al., on Oct. 23, 2007, commonly owned with this application and incorporated herein by reference.

TECHNICAL FIELD

The invention is directed, in general, to medicine storage containers and, more specifically, to a portable medicine cooler having electronic cooling control and medicine efficacy indication circuitry and method of operation thereof.

BACKGROUND

Certain physical conditions or ailments, such as diabetes or allergies, require regular applications of medication. In addition, certain counteractive agents may be required to be available should emergency situations arise. For example, a person who is allergic to wasp stings should have access to medication in case of a wasp sting. In addition, regular and repeated applications of medication may be required, either taken orally or through injection. Many persons with diabetes take insulin by injection to control blood sugar level. Other physical conditions may also require the repeated application or availability of medication either on a life long or temporary basis.

Many medications, however, are subject to rapid degradation of properties as a result of temperature and other environmental conditions. Other medications may be sensitive to light and still others may be sensitive to a combination of light and temperature. Further, many types of medication, particularly those taken by injection, are stored in glass bottles or vials which are subject to breakage if dropped or otherwise traumatized.

As a result, the mobility of those people requiring a constant availability of medication is severely restricted. For example, for one allergic to insect bites, medication must be administered within minutes and sometimes seconds after an insect bite to prevent severe complications, or even death. Likewise, a diabetic must remain near a source of insulin to receive regular injections or an emergency injection should blood sugar level dictate. Therefore, it is desired to provide a means of storing medication such as wasp sting syrum and insulin along with means for administering it in a protective carrying case so that people who require medication may travel about with a supply of such medication.

However, insulin for example, like many other medications, must be kept cold, preferably at approximately 35° Fahrenheit, to maintain its effectiveness. Therefore, people who wish to travel about in warm temperatures require some means of transporting insulin in a temperature controlled environment to maintain it at a desired temperature.

In addition, insulin manufacturers warn against freezing insulin. Therefore, it is desired to provide a way to transport insulin in cold weather that prevents it from reaching the freezing point. Thus, a portable medicine protector is desired to keep cool temperatures in and cold temperatures out.

The prior art evidences a substantially number of efforts to provide a portable medicine protector for insulin and other medicines. U.S. Pat. No. 3,148,515 is directed to medicine chests or kits and has particular reference to portable kits containing a temporary supply of insulin and hypodermic injection equipment for use by diabetics while traveling.

U.S. Pat. No. 4,250,998 is directed to a diabetic travel kit formed by an insulated container having a cavity in which is received a cooling medium container having an annular cooling medium chamber surrounding a top opening compartment. An insulated lid closes the cavity. Top opening pockets may be formed in the peripheral walls of the insulated container, and the lid closes the pockets when the lid is in place closing the cavity.

U.S. Pat. No. 4,343,158 is directed to a portable, flexible, refrigerating pouch for carrying and storing insulin needed by diabetics to prevent it from deterioration is disclosed. The pouch comprises an insulating layer and a liner whose structure provides separate compartments for a refrigerating agent, a vial of insulin and a syringe.

U.S. Pat. No. 4,407,133 is directed to a temperature-controlled chamber comprises a portable, insulated housing with an internal cavity shaped to receive a container of temperature-sensitive material therein. A thermoelectric element, or heat pump, has one face in heat-transfer relation with the housing cavity, and the other face connected with a heat exchanger having an exterior portion exposed to the atmosphere. A source of electric power is coupled to the thermoelectric element through a thermostat control which energizes the thermoelectric element in response to temperature fluctuations in the housing cavity. The thermostat control includes switching means to reverse the polarity of the power supplied to the thermoelectric element as a function of whether the sensed temperature in the housing cavity is too high or too low, to alternatively heat or cool the housing cavity as required to maintain the cavity at a generally constant temperature.

U.S. Pat. No. 4,429,793 is directed to a diabetic traveling case is compact enough to be pocket-sized. The pocket-sized case is equipped to carry at least one bottle of insulin, as well as a refrigerant which maintains the insulin at a suitably low temperature to avoid spoiling.

U.S. Pat. No. 4,738,364 is directed to a portable medicine protector for maintaining the temperature of medicine stored therein from rising above a threshold temperature and for preventing the temperature of medicine stored therein from falling below a second threshold temperature consisting of a hollow walled container having a cavity formed therein. The container is filled with a suitable liquid which may be frozen in an ordinary household freezer environment. A depression or cavity is formed in the container for receiving medicine, such as bottles of liquid medicine. The bottom and sides of the cavity include a plurality of ribbed members to prevent direct contact between a medicine bottle and the side walls of the container. By preventing point contact of the medicine with the side walls of the container, freezing of the medicine is inhibited and in most cases prevented. An outer casing consists of a sleeve of insulating material which may be a pliable foam. The container is inserted into the case, with the case providing additional temperature protection and protection from shock and other trauma. Pockets or other storage areas may be included on the outside of the case for storing accessories, such as syringes, alcohol wipes and swabs.

U.S. Pat. No. 5,704,223 is directed to a personal manually portable thermoelectric-cooling medicine kit, particularly for insulin. The medicine in the kit is cooled by a Peltier heat pump. The vials of medicine inside the kit are tilted to maximize heat transfer efficiency when the kit is either upright or laid flat. A cap is provided to shield an insulin vial from ultraviolet radiation while the case is open and the person is preparing for an injection. The kit includes components which are Velcro-attached to the lining of the kit.

U.S. Pat. No. 5,865,032 is directed to a personal manually portable thermoelectric-cooling medicine kit, particularly for insulin. The medicine in the kit is cooled by a Peltier heat pump. The vials of medicine inside the kit are tilted to maximize heat transfer efficiency when the kit is either upright or laid flat. A cap is provided to shield an insulin vial from ultraviolet radiation while the case is open and the person is preparing for an injection. The kit includes components which are Velcro-attached to the lining of the kit.

U.S. Pat. No. 5,865,314 is directed to an injectable medication carrying case which includes a top panel, a bottom panel opposing the top panel, two opposing side panels, two opposing end panels, and a thermally-insulating divider panel. The top panel, bottom panel, side panels and end panels can be joined together in standard fashion at respective edges of the carrying case. The divider panel partitions the body portion of the case into two distinct thermally-insulated sides. In this arrangement, the patient is able to selectively store his injectable medication supplies in a unitary carrying case, as opposed to a plurality of carrying cases.

U.S. Pat. No. 5,956,968 is directed to a portable cold pack for cold storage and transporting of medicinal vials placed on a holder. The cold pack has a hollow, thin-walled housing and a base having a socket depression therein for receiving the holder. The housing and the base define an interior storage space around the holder. The hollow walls of the housing contain therein refreezable liquid for providing cooling energy. The socket depression orients the holder in the storage space in a close relationship to the interior surface of the hollow, thin-walled housing so as to efficiently cool the medicine within the vials. A closure assembly allows repeated access to the holder within the storage space.

U.S. Pat. No. 5,934,099 is directed to a container for storing and transporting vessels containing a composition susceptible to physicochemical alteration upon changes in temperature above or below a specified temperature range. The container includes a first housing having a vessel holder, and a heat sink disposed within the first housing. A second housing encloses the first housing, the second housing preferably includes a metallic material and is of a double-walled construction.

U.S. Pat. No. 6,935,133 is directed to a temperature control medicine carrying case having an insulated housing, a plurality of interior compartments, an interior pouch, a cooling mechanism and a fastening mechanism, e.g., a zipper closure. The interior surface of the insulated housing includes two separate portions that are separated along a central axis. The interior pouch is located on a first portion of the interior surface of the insulated housing. The interior pouch is adapted to receive the cooling mechanism. At least one of the interior compartments is located on the exterior surface of the interior pouch and is adapted to receive a container of medicine. A plurality of interior compartments is located on the second portion of the interior surface. These compartments are adapted to receive medical devices that are used for administration of the medicine.

U.S. Pat. No. 6,253,570 is directed to a traveling bag for carrying temperature-sensitive medications such as insulin which includes a sensor monitoring the interior temperature and an exterior display showing the measured temperature. In one embodiment the bag interior includes a compartment for storing medication, an assembly for securely holding three insulin pens, and a compartment for holding a container of freezing material. A second embodiment of the bag omits the freezing material compartment.

U.S. Pat. No. 6,959,814 is directed to a portable insulin and accessory kit for diabetics that is a case made of polymeric or waterproof material having an inside portion divided in three equal sections, each section securing and storing insulin and accessories such as an insulin pen or syringe, alcohol cloths or similar accessories for sterilization and a supply of additional needles. The kit is foldable and provides hook and loop fasteners for a secure closure. In addition, a polymeric, portable insulin storage box is provided having a hingedly attached cover attached to a bottom portion having divided sections for the storage of insulin and accessories such as an insulin pen or syringe, alcohol cloths or similar accessories for sterilization and a supply of additional needles.

U.S. Pat. No. 6,044,650 is directed to a container for storing and transporting vessels containing a liquid composition susceptible to physico-chemical alteration upon changes in temperature above or below a specified temperature. It comprises an enclosure having a lower portion, a top portion and a side portion between the lower and top portions thereby defining an inner space. A lower portion of the enclosure contains a first heat sink within a base, comprising a thermal energy absorbing substance. A vial holder in the inner space holds one or more of the vessels in the inner space above the first heat sink and substantially spaced from an insulated insert inside of the enclosure. An insulating gas is contained in the inner space. A temperature indicator in the inner space indicates when the inner space has been subjected to temperatures below a predetermined level.

U.S. Published Patent Application No. 2005/0016895 is directed to a travel case for transporting insulin is provided with an outer bottle with an outer bottle cap, an inner bottle with an inner bottle cap, fins, and a means to thermally insulate the outer bottle. The inner bottle is located within the outer bottle. The fins are attached to and protrude radially from the inner bottle, thus acting to keep the inner bottle centrally located within and relative to the outer bottle, as well as to keep the inner bottle in a substantially upright position within the outer bottle. The inner bottle is adapted to receive one or more bottles of insulin. In use, ice is added to the outer bottle between the fins, the ice acting as a heat sink to keep the insulin bottles cold within the inner bottle.

U.S. Published Patent Application No. 2005/0081558 is directed to a portable container including: a box member, a Stirling cooler as a temperature controlling unit for refrigerating the inside of the box member, an operation unit for controlling the Stirling cooler, and handles for supporting the box member by grasping. Cutouts are formed between an upper surface of the box member and both side surfaces thereof, the operation unit is provided on one of the cutouts, and the handles are provided outwardly relative to the cutouts respectively.

U.S. Pat. No. 7,240,513 is directed to a portable thermally-controlled container system includes an outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case, and an inner case configured to fit in the chamber provided by the outer case, the inner case including a first thermally-reflective layer and a first insulation layer disposed inwardly of the first thermally-reflective layer, the inner case providing a second inner chamber disposed inwardly of the first insulation layer.

In general, the particular portable medicine coolers described above are substantially limited in terms of the length of time they can cool, the accuracy and sophistication with which they can monitor, control and report temperature and by extension indicate potential issues with medicinal efficacy, their portability or their flexibility. What is needed in the art is a superior portable medicine cooler and an accompanying method of operating such a cooler.

SUMMARY

To address the above-discussed deficiencies of the prior art, one aspect of the invention provides a portable medicine cooler. In one embodiment, the portable medicine cooler includes: (1) a shell having a grille and further having a door configured to provide access to a cavity within the shell for containing a medicine to be cooled, (2) a cooling and receiving structure coupled to the shell and including a thermoelectric cooler (TEC) interposing a heat sink and a vial receiver and (3) electronic cooling control and medicine efficacy indication circuitry coupled to the cooling and receiving structure and including a processor, at least one temperature sensor configured to provide a signal to the processor indicating a temperature associated with the portable medicine cooler, a battery configured to provide power to the processor and an indicator selected from the group consisting of at least one light-emitting diode and a liquid-crystal display and configured to provide an indication of an operation of the portable medicine cooler.

Another aspect of the invention provides a method of operating a medicine cooler. In one embodiment, the method includes: (1) placing at least one medicine vial containing medicine to be cooled in a cavity in a shell having a grille and further having a door configured to provide access to the cavity, (2) providing power to a TEC in a cooling and receiver structure, the cooling and receiver structure coupled to the shell and also including a heat sink and a vial receiver straddling the TEC and (3) controlling the power with electronic cooling control and medicine efficacy indication circuitry coupled to the cooling and receiving structure and including a processor, at least one temperature sensor configured to provide a signal to the processor indicating a temperature associated with the portable medicine cooler, a battery configured to provide power to the processor and an indicator selected from the group consisting of at least one light-emitting diode and a liquid-crystal display and configured to provide an indication of an operation of the portable medicine cooler.

The foregoing has outlined certain aspects and embodiments of the invention so that those skilled in the pertinent art may better understand the detailed description of the invention that follows. Additional aspects and embodiments will be described hereinafter that form the subject of the claims of the invention. Those skilled in the pertinent art should appreciate that they can readily use the disclosed aspects and embodiments as a basis for designing or modifying other structures for carrying out the same purposes of the invention. Those skilled in the pertinent art should also realize that such equivalent constructions do not depart from the scope of the invention.

BRIEF DESCRIPTION OF THE DRAWINGS

For a more complete understanding of the invention, reference is now made to the following descriptions taken in conjunction with the accompanying drawings, in which.

DETAILED DESCRIPTION OF CERTAIN ASPECTS AND EMBODIMENTS

Disclosed herein are various embodiments of portable medicine cooler. The disclosed embodiments have some elements in common, namely a heat sink (a body of any shape that receives and dissipates heat), a battery (of any conventional or later-developed type), a TEC (also called a Peltier device) and an electronic cooling controller (which may take the form of a separate integrated circuit, or IC, chips mounted on a printed-circuit board PCB).

The portable medicine cooler is a solid-state, thermally regulated cooling system designed originally for insulin or other medicinal storage for maintaining and monitoring the temperature of medicine supplies to increase the likelihood of their continued potency. The portable medicine cooler may assume many different embodiments. In a first embodiment, the portable medicine cooler is small and accepts a single medicine vial. The first embodiment portable medicine cooler is highly portable, generally pocketable, tolerates a reasonable range of temperatures and is suitable for use during a given day. In a second embodiment, the portable medicine cooler is somewhat larger and accepts two medicine vials. The second embodiment portable medicine cooler is stowable in a briefcase or laptop computer bag, tolerates a wider range of temperatures and is suitable for use overnight. In a third embodiment, the portable medicine cooler approximates the size of a small toaster and holds several medicine vials. The third embodiment portable medicine cooler is packable in a small suitcase, tolerates a wide range of temperatures and is suitable for use over several days, such as a weekend. The second embodiment will now be described, with the understanding that the first and third embodiments are constructed using the same principles.

Figure 1:
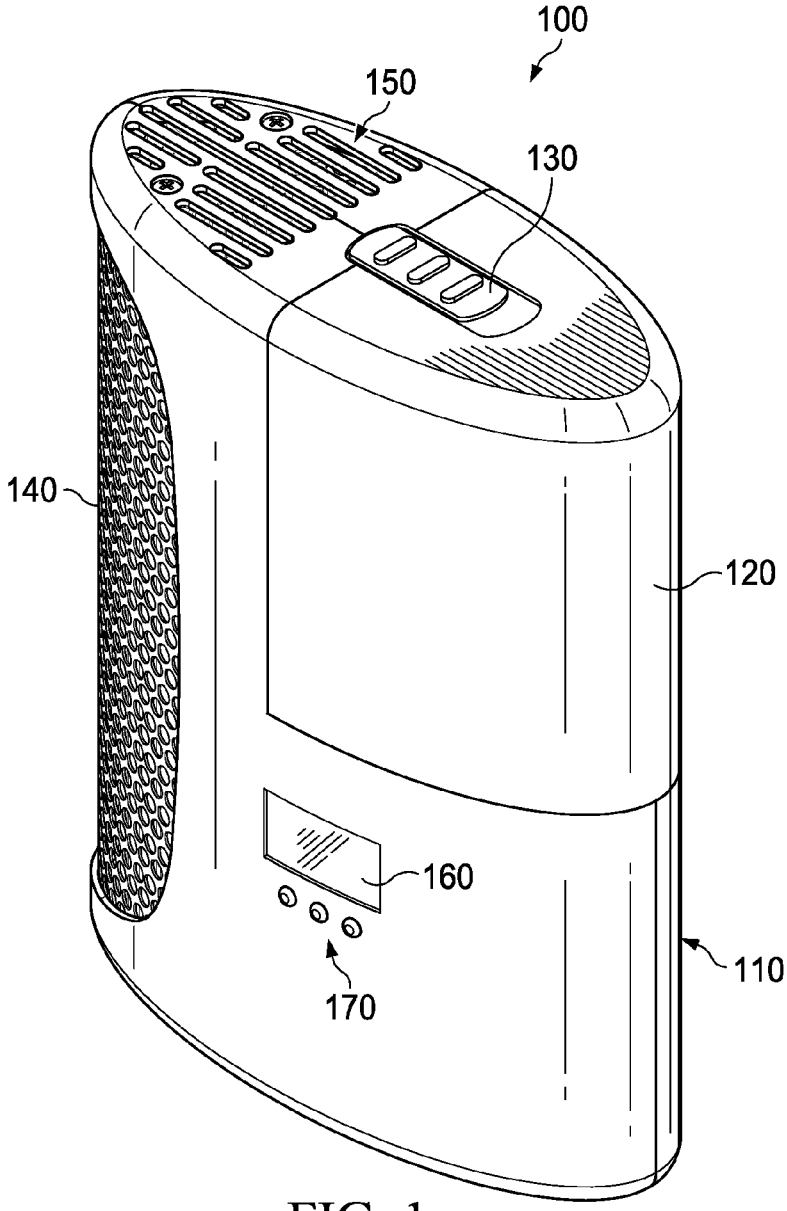
FIG. 1 is an isometric view of one embodiment of a portable medicine cooler having electronic cooling control constructed according to the principles of the invention.

FIG. 1 is an isometric view of one embodiment of a portable medicine cooler 100 having electronic cooling control constructed according to the principles of the invention. The portable medicine cooler 100 has a shell 110 which may be opaque and molded, high-impact plastic or formed of another suitable material. The shell 110 has a door 120 that may pivot or slide relative to the remainder of the shell 110 to reveal a cavity for containing the medicine to be cooled. A latch 130 may be provided to secure the door 120 in its closed position. A grille 140 may reside in an opening formed in a side of the shell 110. The grille 140 allows air to pass into a portion of the shell in which a heat sink (not shown in FIG. 1) is located. The grille 140 may be formed of high-impact plastic, metal or of another suitable material. The grille 140 may be a separate piece as shown or integral with the shell 110. A further grille 150 may be located in one or both of the ends of the shell 110. The further grille 150 also allows air to pass into the portion of the shell in which the heat sink is located. The further grille 150 may be formed of high-impact plastic, metal or of another suitable material. The further grille 150 may be a separate piece or integral with the shell 110 as shown.

Figure 2:
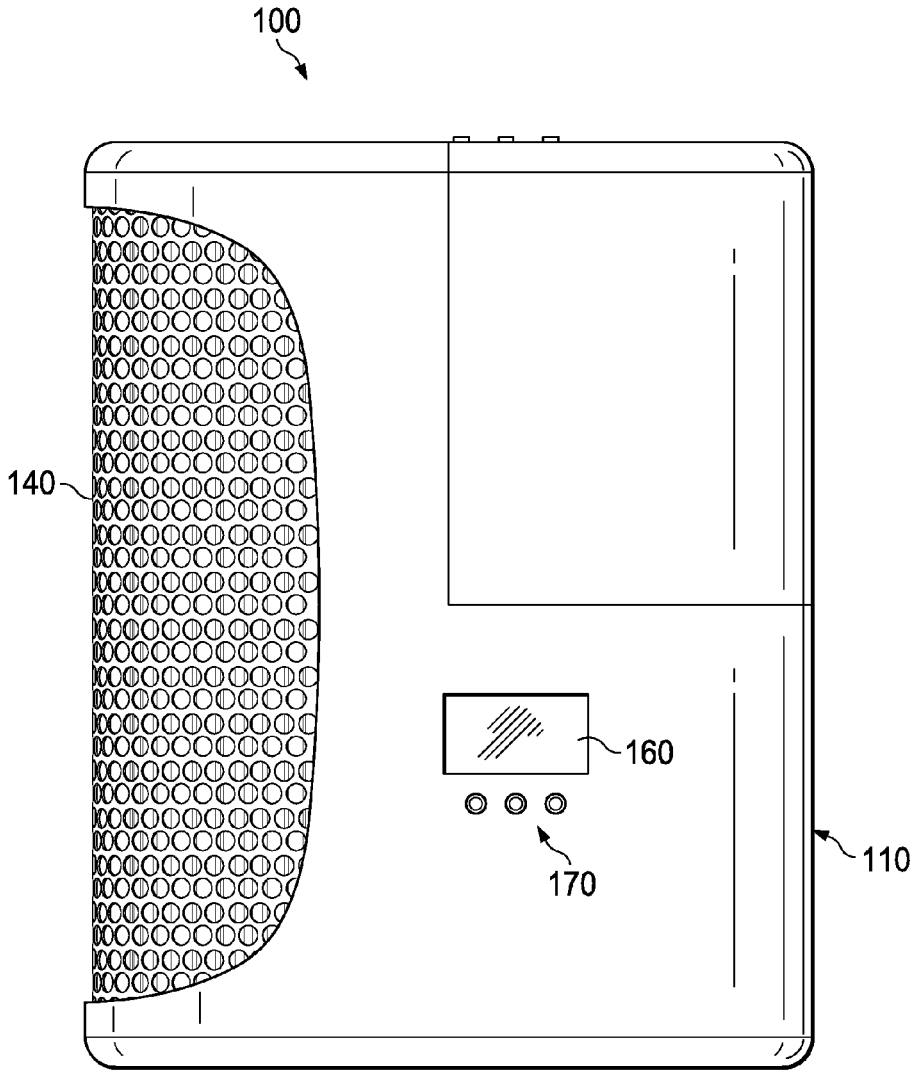
FIG. 2 is a right-side elevational view of the portable medicine cooler of FIG. 1.

A liquid-crystal display (LCD) 160 is located on one side of the shell 110. As will be described later, the LCD 160 may be used to communicate information about the portable medicine cooler 100 and/or the medicine contained therein to a user. The user may use one or more buttons 170 located on one side of the shell 110 to change the operation of the portable medicine cooler 110, the contents of the LCD 160 or any other purpose as the electronic cooling controller may provide. FIG. 2 is a right-side elevational view of the portable medicine cooler of FIG. 1 that shows many of the elements shown in FIG. 1.

Figure 3:
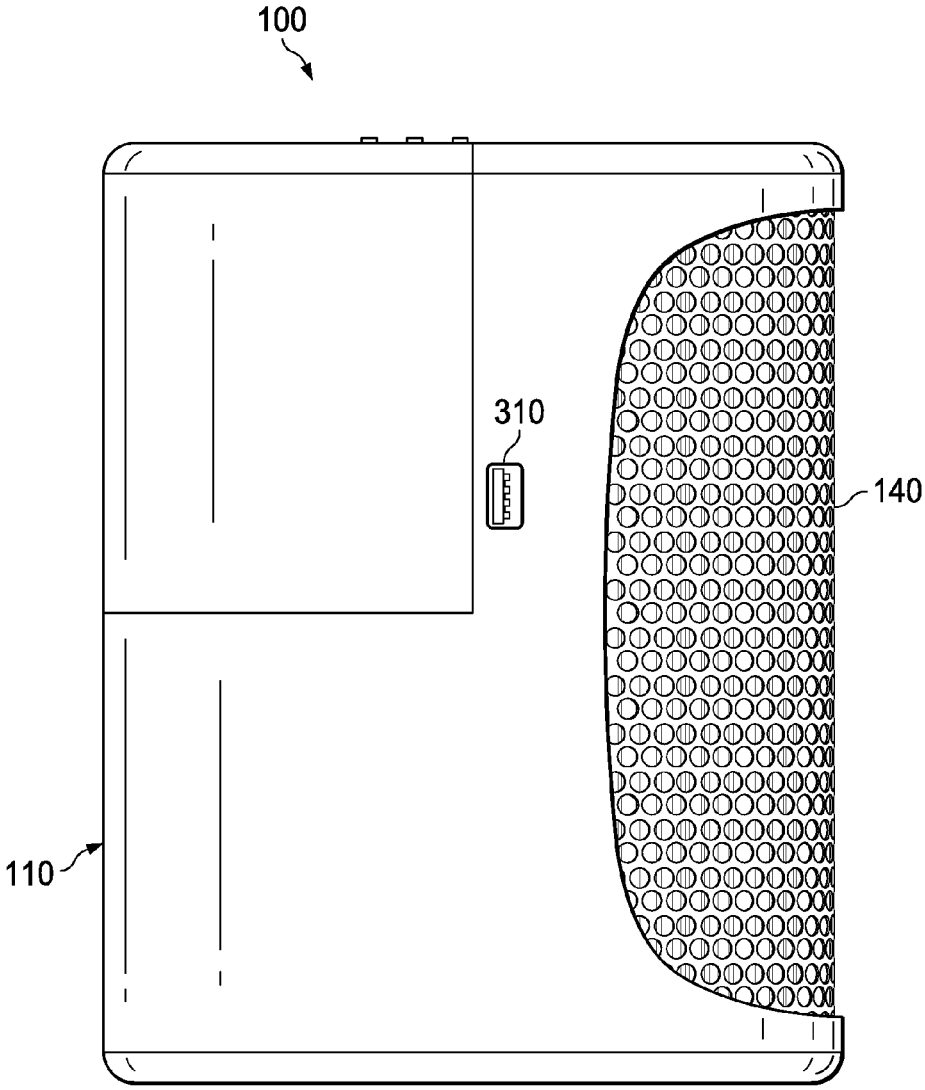
FIG. 3 is a left-side elevational view of the portable medicine cooler of FIG. 1.

FIG. 3 is a left-side elevational view of the portable medicine cooler of FIG. 1. Like FIG. 2, FIG. 3 shows many of the elements shown in FIG. 1. FIG. 3 also shows a port 310, which may be a Type B Universal Serial Bus (USB) receptacle. The port 310 may, of course, be of any other conventional or later-discovered type.

In the illustrated embodiment, the port 310 is employed to receive a cable of a plug-in recharger, allowing the recharger to recharge one or more batteries (not shown) within the shell 110 of the portable medicine cooler 100. In another embodiment, the port 310 is employed to receive a cable that allows data to be transferred to or from the electronic cooling controller (not shown) that is within the shell 110 of the portable medicine cooler 100. The data may be used to load parameters or software into the portable medicine cooler 100 that together control its operation or extract from the portable medicine cooler 100 historical information (e.g., logs) regarding its operation for external analysis or reporting.

Figure 4A:
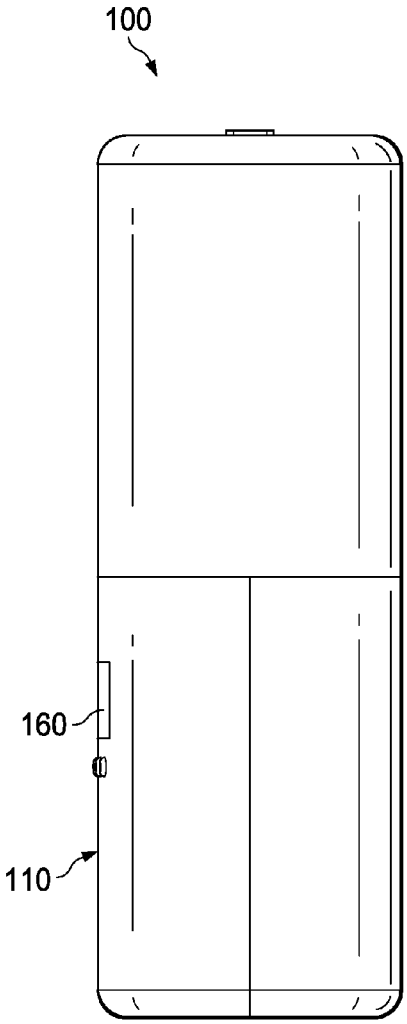
FIG. 4A is a rear-side elevational view of the portable medicine cooler of FIG. 1.
Figure 4B:
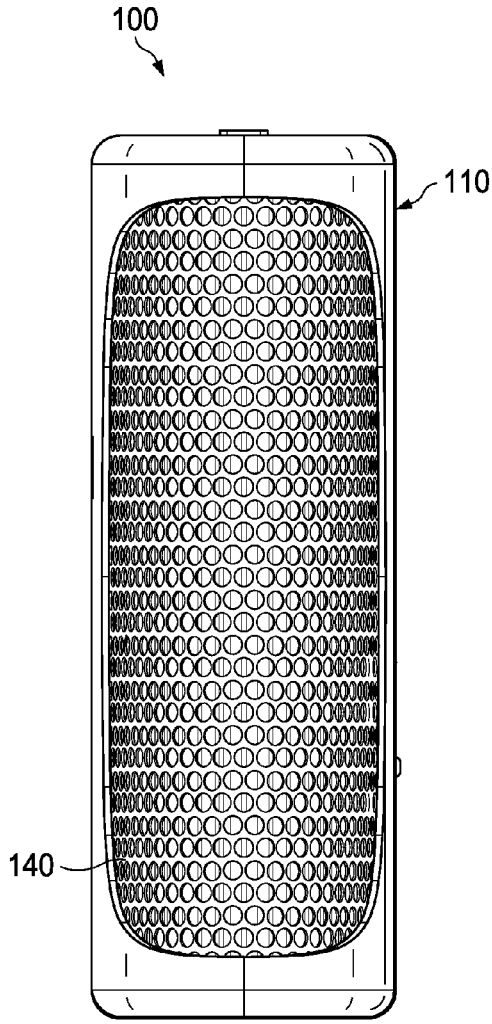
FIG. 4B is a front-side elevational view of the portable medicine cooler of FIG. 1.
Figure 5A:
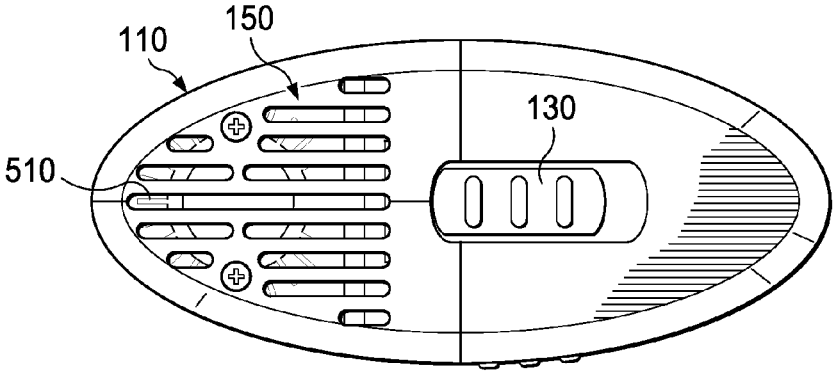
FIG. 5A is a top-side plan view of the portable medicine cooler of FIG. 1.
Figure 5B:
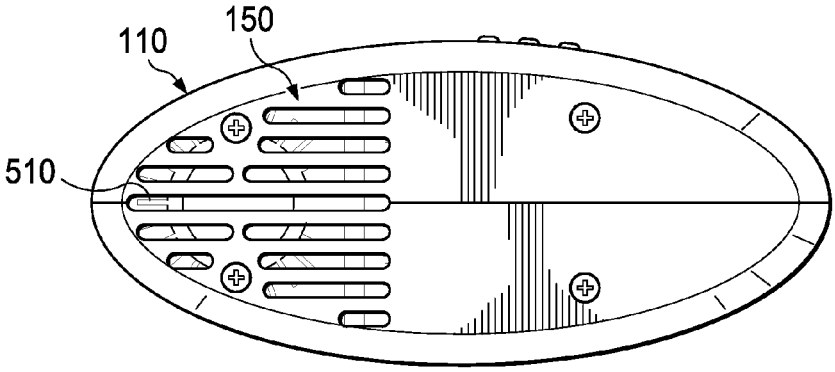
FIG. 5B is a bottom-side plan view of the portable medicine cooler of FIG. 1.

FIGS. 4A, 4B, 5A and 5B present rear-side elevational, front-side elevational, top-side plan and bottom-side plan views of the portable medicine cooler of FIG. 1. FIG. 4B shows the illustrated embodiment of the grille 140 more thoroughly, while FIG. 5A shows the illustrated embodiment of the latch 130. FIGS. 5A and 5B respectively show top and bottom ends of a generally cylindrical heat sink 510 viewed through slots in the further grille 150. Screws or bolts (shown but unreferenced) may be employed to mount the heat sink 510 and other internal components of the portable medicine cooler 100 within the shell 110. In one embodiment, the heat sink 510, being generally cylindrical, is configured to receive one or more batteries in a hollow core thereof. Batteries often have a slightly higher capacity at higher operating temperatures. Locating batteries in the hollow core of the heat sink 510 serves to extend battery life when the portable medicine cooler of FIG. 1 is cooling.

Figure 6:
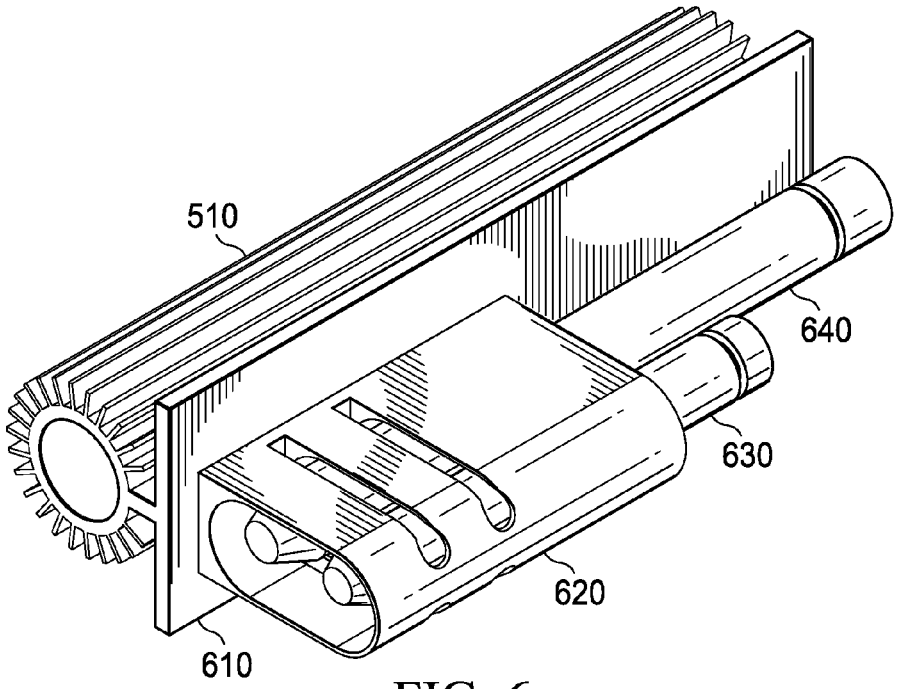
FIG. 6 is an isometric view of one embodiment of a cooling and receiving structure for the portable medicine cooler of FIG. 1.

The heat sink 510 is part of an overall cooling and receiving structure, one embodiment of which is shown in FIG. 6 and will now be described. FIG. 6 is an isometric view of one embodiment of a cooling and receiving structure for the portable medicine cooler of FIG. 1. As stated above, the illustrated embodiment of the portable medicine cooler 100 is configured to receive and store two vials of medicine. "Vials" is a generic term defined to include generally elongated packages including tubes, ampules, cartridges and pens, such as Novodisk insulin pens, Lilly insulin pens or Lantus insulin pens or cartridge systems. Accordingly, FIG. 6 shows the generally cylindrical heat sink 510 as having a plurality of unreferenced fins radiating outwardly. Though not necessary to the illustrated embodiment, the fins increase the overall surface area of the heat sink 510 and thereby its capacity to dissipate heat.

A TEC 610 is located in thermal communication with the heat sink 510. Those skilled in the pertinent art understand that a TEC acts as a heat pump in response to an electrical current applied via terminals thereof (not shown) and pumps heat from one of its sides to the other based on the magnitude and direction of the current. A general discussion of TECs is outside of the scope of this disclosure. However, a particular TEC suitable for use in the context of the embodiment of FIG. 6 is commercially available from the Melcor division of Laird Technologies of Trenton, N.J.

A vial receiver 620 is associated, and may be in thermal communication, with the TEC 610. The vial receiver 620 is configured to receive one or more medicine vials. In the embodiment of FIG. 6, the vial receiver 620 is configured to receive two medicine vials 630, 640 as shown. The vial receiver 620 of FIG. 6 is configured to be in substantial thermal communication with the vials 630, 640 such that it can remove any excess heat efficiently. The medicine vials 630, 640 may be of the same or a different physical configuration (i.e., length, diameter, composition or operation). The vial receiver 620 may be a simple container as FIG. 6 shows or may incorporate an ejection structure that includes a spring-loaded J-slot. As those skilled in the pertinent art understand, a spring-loaded J-slot is actuated by the insertion of an object (e.g., vial) by retracting to and remaining in a retracted position. If the object is subsequently pressed, the spring-loaded J-slot initially retracts somewhat and then extends to and remains in an extended position which urges and ejects the object such that it protrudes. In the context of FIG. 6, the vial (630 or 640) whichever the user intended) would protrude for easier removal from the portable medicine cooler 100 of FIG. 1.

The thermal operation of the cooling and receiving structure is straightforward. Under control of the TEC 610, heat is moved between the vial receiver 620 and the heat sink 510. Most often, it is expected that the TEC 610 moves heat from the vial receiver 620 to the heat sink 510. In this way, heat is moved into or out of the medicine vials 630, 640 in a controllable manner. Of course, the TEC 610 may move heat from the heat sink 510 to the vial receiver 620 to warm any vials in the vial receiver 620. The invention encompasses either or both directions of heat flow.

Figure 7:
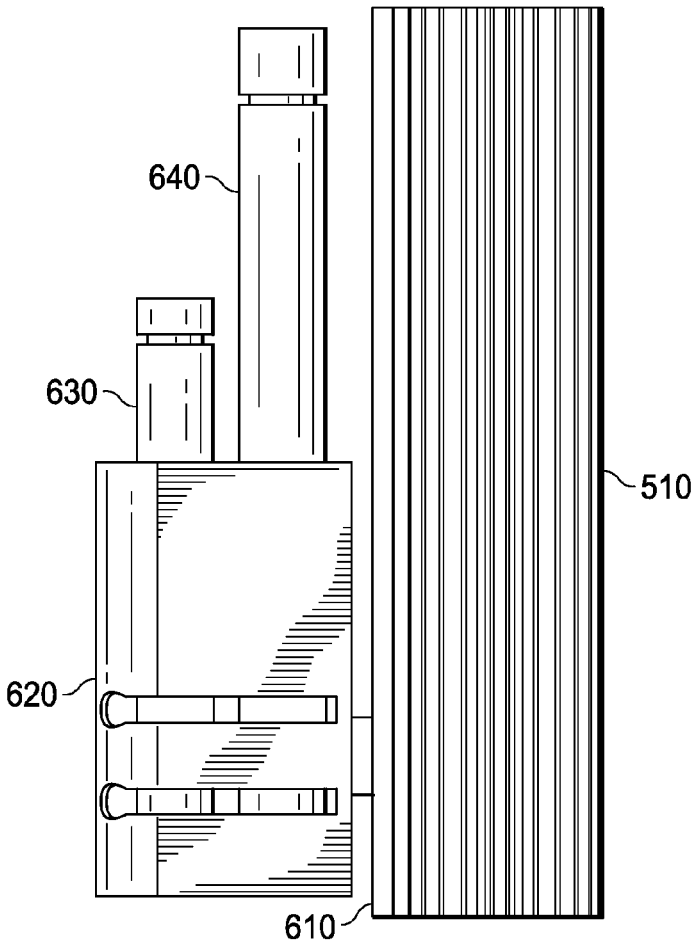
FIG. 7 is a left-side elevational view of one embodiment of a cooling and receiving structure for the portable medicine cooler of FIG. 1.

FIG. 7 is a left-side elevational view of one embodiment of a cooling and receiving structure for the portable medicine cooler of FIG. 1. Among other things, FIG. 7 shows in greater detail one way in which the TEC 610 may be mechanically coupled to the vial receiver 620. Those skilled in the pertinent art will understand, however, that the cooling and receiving structure may assume many different alternative forms and configurations and that the particular embodiment of FIGS. 6 and 7 provide but one example.

Figure 8:
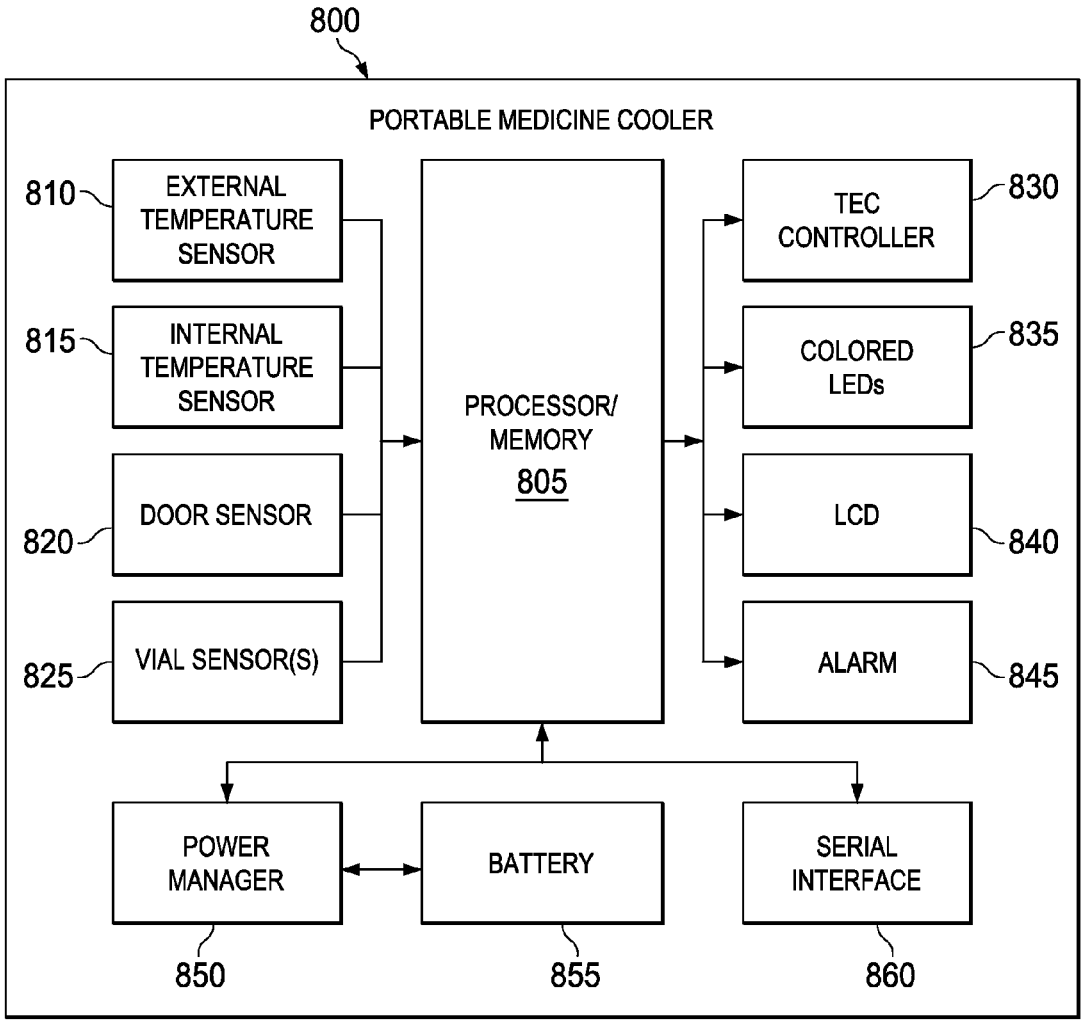
FIG. 8 is a block diagram of one embodiment of electronic cooling controller and medicine efficacy indication circuitry constructed according to the principles of the invention.

FIG. 8 is a block diagram of one embodiment of electronic cooling controller and medicine efficacy indication circuitry 800 constructed according to the principles of the invention. At the core of the electronic cooling controller and medicine efficacy indication circuitry are a processor and memory 805. The processor and memory 805 may be of any type, speed and capacity suitable for a particular embodiment. In the embodiment of FIG. 8, the processor is a general-purpose complementary metal-oxide semiconductor (CMOS) microprocessor. The type, speed and capacity of the processor and memory 805 are such that their power consumption is low, but their capability is sufficient to perform the tasks that the electronic cooling controller and medicine efficacy indication circuitry 800 is to perform.

The illustrated embodiment of the electronic cooling controller and medicine efficacy indication circuitry 800 includes an external temperature sensor 810. The external temperature sensor 810 is coupled to the processor and memory 805 and configured to provide a signal indicating the temperature outside the portable medicine cooler. The illustrated embodiment of the electronic cooling controller and medicine efficacy indication circuitry 800 also includes an internal temperature sensor 815. The internal temperature sensor 815 is coupled to the processor and memory 805 and configured to provide a signal indicating the temperature of one or more of the medicine vials. Certain embodiments of the electronic cooling controller and medicine efficacy indication circuitry 800 may include one or more other temperature sensors in addition to or in lieu of the external temperature sensor 810 and the internal temperature sensor 815. The processor and memory 805 are configured to use one or both of the external temperature sensor 810 and the internal temperature sensor 815 and perhaps other temperature sensors to control the TEC 610 of FIG. 6.

The illustrated embodiment of the electronic cooling controller and medicine efficacy indication circuitry 800 includes a door sensor 820. The door sensor 820 is coupled to the processor and memory 805 and configured to provide a signal indicating whether or not the door 120 of FIG. 1 is open or closed. The illustrated embodiment of the electronic cooling controller and medicine efficacy indication circuitry 800 also includes one or more vial sensors 825. The one or more vial sensors 825 are coupled to the processor and memory 805 and configured to provide one or more corresponding signals indicating whether or not vials are contained in the vial receiver 620 of FIG. 6. The processor and memory 805 are configured to use the door sensor 820 to indicate to a user when the door is open, and cooling is being lost. The processor and memory 805 are configured to use the vial sensors 825 to indicate whether vials are contained in the portable medicine cooler without requiring the user to open the door and lose cooling.

The illustrated embodiment of the electronic cooling controller and medicine efficacy indication circuitry 800 includes a TEC controller 830. The TEC controller 830 responds to commands by the processor and memory 805 to direct current to the TEC 610 of FIG. 6. The illustrated embodiment of the TEC controller can adjust both the magnitude and direction of the current.

The illustrated embodiment of the electronic cooling controller and medicine efficacy indication circuitry 800 may include one or more of colored light-emitting diodes (LEDs) 835. In the illustrated embodiment, four LEDs are used: green, yellow, red and blue. The LED indicators illuminate for a few seconds upon opening the door 160 of FIG. 1 and are used to indicate the general (approximate) efficacy of the medicine contained in the portable medicine cooler. Table 1, below, shows lifetimes of certain commercially available insulin products.

TABLE 1

Lifetimes of Certain Insulin Products

| | Unopened Refrigerated (36° F.-46° F.) | Unopened Room Temp (59° F.-86° F.) | Opened (36° F.-86° F.) |
|---|---|---|---|
| Lilly Humalog and regular vials | Until Exp. Date (Usually 18 months) | Max 28 days | Max 28 days |
| Humalog Mix pens (fast/slow) | Until Exp. Date (Usually 18 months) | Max 28 days | Max 10 days |
| Insulin Pump Reservoir | Until Exp. Date (Usually 18 months) | N/A | 48 hours |
| LANTUS vials | Until Exp. Date (Usually 18 months) | Max 28 days | Max 28 days |
| LANTUS pens and Solostar | Until Exp. Date (Usually 18 months) | | Max 28 days Must be 59° F.-86° F. |

Efficacies are based on lifetimes and storage conditions. In the illustrated embodiment, the processor and memory 805 activates the green LED when refrigeration has remained in proper temperature specification since the last completed charge cycle. The processor and memory 805 activates the yellow LED when refrigeration has been at a reduced capacity predetermined such that the medications contained in the medicine vials might be at a reduced efficacy. The processor and memory 805 activates the red LED when refrigeration has not been maintained such that the medications contained in the medicine vials are likely to be ineffective or harmful. The processor and memory 805 activates the blue LED to indicate battery life. For example, the blue LED may remain on when the battery is at 80% or more of its capacity; the blue LED may blink slowly (e.g., <1 Hz) when the battery is between 30% and 80% of its capacity; and the blue LED may blink quickly (e.g., >2 Hz) when the battery is between 1% and 30% of its capacity.

The illustrated embodiment of the electronic cooling controller and medicine efficacy indication circuitry 800 may include an LCD 840, such as the LCD 160 of FIG. 1. The LCD 840 may be used in addition to or in lieu of the colored LEDs 835 to indicate operating conditions or other indicia to a user.

The illustrated embodiment of the electronic cooling controller and medicine efficacy indication circuitry 800 may include an alarm 845, such as a piezoelectric transducer. The alarm 845 may be used in addition to or in lieu of the colored LEDs 835, the LCD 840 or both to indicate operating conditions or other indicia to a user or issue warnings requiring the user's attention.

The illustrated embodiment of the electronic cooling controller and medicine efficacy indication circuitry 800 may include a power manager 850. In general, the power manager 850 is tasked with monitoring a battery 855, managing its charge if it is a chargeable battery and managing its discharge if the battery 855 is subject to memory effects. In the illustrated embodiment, the battery 855 may be one of the following commercially available models: a CR123A primary non-rechargeable Li-Ion cell, 3V, 1300 mAh; a RCR123A rechargeable Li-Ion cell, 3V, 750 mAh; a RCR123A rechargeable Li-Ion cell, 3.6V, 880 mAh; or an 18650 rechargeable Li-Ion cell, 3.7V, 2200 mAh.

The illustrated embodiment of the electronic cooling controller and medicine efficacy indication circuitry 800 may include a serial interface 860. The serial interface 860 may be a Type B ("mini") USB interface. The serial interface 860 may be used to charge the battery 855, provide primary power to the portable medicine cooler or for data (e.g., logs or software) transfer to or from the portable medicine cooler. In an alternative embodiment, another type of interface may be used to charge the batter 855 or provide primary power to the portable medicine cooler. In yet another embodiment, another type of data interface may be employed to transfer data into or out of the portable medicine cooler. Those skilled in the pertinent art will understand that any combination or permutation of power or data interface falls within the broad scope of the invention.

Figure 9:
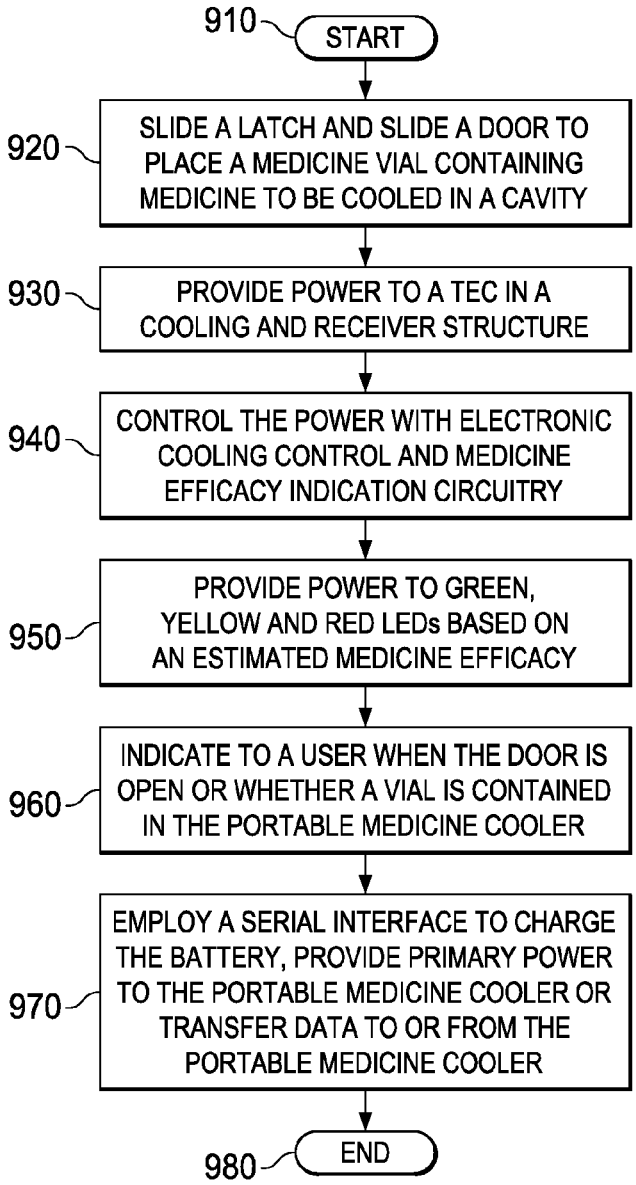
FIG. 9 is a flow diagram of one embodiment of a method of operating a portable medicine cooler having electronic cooling control carried out according to the principles of the invention.

FIG. 9 is a flow diagram of one embodiment of a method of operating a portable medicine cooler having electronic cooling control carried out according to the principles of the invention. The method begins in a start step 910. In a step 920, a latch may be slid and a door may be slid to place at least one medicine vial containing medicine to be cooled in a cavity in a shell, the shell having a grille. In a step 930, power is provided to a TEC in a cooling and receiving structure, the cooling and receiving structure coupled to the shell and also including a heat sink and a vial receiver straddling the TEC. In a step 940, the power is controlled with electronic cooling control and medicine efficacy indication circuitry coupled to the cooling and receiving structure and including a processor. In a step 950, providing power to green, yellow and red LEDs based on an estimated medicine efficacy. In a step 960, an indication is made to a user when the door is open or whether a vial is contained in the portable medicine cooler. In a step 970, a serial interface is employed to charge the battery, provide primary power to the portable medicine cooler, transfer data to or from the portable medicine cooler or perform multiple of these functions. The method ends in an end step 980.

Those skilled in the art to which the invention relates will appreciate that other and further additions, deletions, substitutions and modifications may be made to the described embodiments without departing from the scope of the invention.

What is claimed is:

1. A method of operating a medicine cooler, comprising:

receiving at least one medicine vial containing medicine to be cooled in a cavity in a shell having a grille and further having a door configured to provide access to said cavity;

providing power to a thermoelectric cooler in a cooling and receiver structure, said cooling and receiver structure coupled to said shell and also including a heat sink with a hollow core and a vial receiver straddling said thermoelectric cooler, wherein said thermoelectric cooler connects said heat sink to said vial receiver; and controlling said power with electronic cooling control and medicine efficacy indication circuitry coupled to said cooling and receiving structure and including a processor, at least one temperature sensor configured to provide a signal to said processor indicating a temperature associated with said portable medicine cooler, a battery configured to provide power to said processor and located in said hollow core of said heat sink, and an indicator selected from the group consisting of at least one light-emitting diode and a liquid-crystal display and configured to provide an indication of an operation of said portable medicine cooler.

2. The method as recited in claim 1 wherein said medicine cooler is sized to fit within a briefcase.

3. The method as recited in claim 1 wherein said heat sink is generally cylindrical with a plurality of fins radiating outwardly.

4. The method as recited in claim 1 wherein said vial receiver is configured to receive at least two medicine vials.

5. The method as recited in claim 1 wherein said indicator includes green, yellow and red light-emitting diodes, said controlling comprising providing power to one of said green, yellow and red light-emitting diodes based on an estimated efficacy of medicine contained in said portable medicine cooler.

6. The method as recited in claim 1 further comprising indicating when said door is open.

7. The method as recited in claim 1 further comprising indicating whether a vial is contained in said portable medicine cooler.

8. The method as recited in claim 1 further comprising issuing a warning with an alarm coupled to said processor.

9. The method as recited in claim 1 further comprising employing a serial interface to perform at least one action selected from the group consisting of:

charging said battery, providing primary power to said portable medicine cooler, and transferring data to or from the portable medicine cooler.

10. A portable medicine cooler, comprising:

a shell having a grille and further having a door configured to provide access to a cavity within said shell for containing a medicine to be cooled;

a self-cooling and receiving structure coupled to said shell and including a thermoelectric cooler interposing a vial receiver and a heat sink with a hollow core, wherein said thermoelectric cooler connects said heat sink to said vial receiver; and electronic cooling control and medicine efficacy indication circuitry coupled to said cooling and receiving structure and including a processor, at least one temperature sensor configured to provide a signal to said processor indicating a temperature associated with said portable medicine cooler, a battery configured to provide power to said processor and located in said hollow core of said heat sink, and an indicator selected from the group consisting of at least one light-emitting diode and a liquid-crystal display and configured to provide an indication of an operation of said portable medicine cooler.

11. The portable medicine cooler as recited in claim 10 wherein said shell is sized to fit within a briefcase.

12. The portable medicine cooler as recited in claim 10 wherein said door is configured to slide relative to said shell to reveal said cavity and is configured to be secured in a closed position by a latch.

13. The portable medicine cooler as recited in claim 10 wherein said vial receiver is configured to receive at least two medicine vials.

14. The portable medicine cooler as recited in claim 10 wherein said indicator includes green, yellow and red light-emitting diodes, said processor configured to provide power to one of said green, yellow and red light-emitting diodes based on an estimated efficacy of medicine contained in said portable medicine cooler.

15. The portable medicine cooler as recited in claim 10 wherein said electronic cooling control and medicine efficacy indication circuitry includes a door sensor configured to indicate to a user when said door is open.

16. The portable medicine cooler as recited in claim 10 wherein said electronic cooling control and medicine efficacy indication circuitry includes a vial sensor configured to indicate whether a vial is contained in said portable medicine cooler.

17. The portable medicine cooler as recited in claim 10 wherein said electronic cooling control and medicine efficacy indication circuitry includes an alarm configured to issue a warning to a user.

18. The portable medicine cooler as recited in claim 10 wherein said electronic cooling control and medicine efficacy indication circuitry includes a serial interface configured to perform at least one action selected from the group consisting of:

charging said battery, providing primary power to said portable medicine cooler, and transferring data to or from the portable medicine cooler.

19. The portable medicine cooler as recited in claim 10 wherein said heat sink is generally cylindrical with fins radiating outwardly from said hollow core.

20. The portable medicine cooler as recited in claim 10 wherein said battery has the physical dimensions of a CR123A battery or an 18650 battery.

* * * * *